United States Patent [19]

Bienvenu et al.

[11] 4,042,377

[45] Aug. 16, 1977

[54] METHOD OF AND COMPOSITION FOR THE DESULFURIZATION OF STEEL

[75] Inventors: Gérard Bienvenu, Annemasse, France; Claude Gentaz, Grand-Lancy, Geneva, Switzerland

[73] Assignee: Battelle Memorial Institute, Carouge, Geneva, Switzerland

[21] Appl. No.: 532,860

[22] Filed: Dec. 16, 1974

[30] Foreign Application Priority Data

Dec. 14, 1973 Switzerland ..... 17528/73

[51] Int. Cl.[2] ..... C21C 7/02

[52] U.S. Cl. ..... 75/53; 75/58; 75/130 R

[58] Field of Search ..... 75/53–58, 75/130 R

[56] References Cited

U.S. PATENT DOCUMENTS

| | | | |
|---|---|---|---|
| 2,747,990 | 5/1956 | Morrogh | 75/53 |
| 3,197,306 | 7/1965 | Osborn | 75/53 |
| 3,588,069 | 6/1971 | Lyman | 75/53 |
| 3,619,171 | 11/1971 | Bakkerus | 75/58 |

*Primary Examiner*—P. D. Rosenberg
*Attorney, Agent, or Firm*—Karl F. Ross; Herbert Dubno

[57] ABSTRACT

A process for the desulfurization or nodularization of a ferrous melt which comprises introducing into the melt at least one reducing composition formed between an element of one of the groups I, II and III of the Periodic Table of elements (except for hydrogen and boron) and at least one element selected from the group which consists of hydrogen, boron, carbon, silicon, nitrogen and phosphate or a combination of one of them with sulfur, and at least one composition reducible by the reducing composition of at least one metal selected from the group which consists of the alkaline metals and the metals of groups II and III of the Periodic Table. The mixture is of a composition within the portion of the phase diagram of the mixture corresponding to a single homogeneous liquid phase in the region of temperatures above the melting point of the alloy to be treated. The treating composition is used in the form of a homogeneous liquid or a substantially homogeneous solid which melts at contact with the alloy.

23 Claims, No Drawings

METHOD OF AND COMPOSITION FOR THE DESULFURIZATION OF STEEL

FIELD OF THE INVENTION

The present invention relates to a process for modifying the physical properties and/or the chemical composition of a metal alloy. The invention also relates to a composition for the treatment of a metal alloy. More particularly, the invention relates to a process for reducing the sulfur level of a ferrous alloy such as a cast iron or a steel and for improving the mechanical properties of a cast iron melt, namely, its brittleness, its tensile strength and its elongation to break by transforming the gray cast iron into nodular iron.

BACKGROUND OF THE INVENTION

At this time there are several processes for reducing the sulfur level of ferrous alloys such as cast-iron melts and steels.

One of these processes consist in introducing into the ferrous alloy, preferably brough to the liquid state by heating to a temperature at least equal to its melting point, a predetermined quantity of a mineral metallic composition such as a carbide, silicide or oxide of calcium, magnesium the manganese oxide MnO etc., less stable at the temperature of the molten alloy than the sulfide of the metal of this composition, i.e. the sulfide of calcium, magnesium or maganese.

It has also been proposed to introduce into a molten ferrous alloy a metal having the property of forming a sulfide of the metal stable at the temperature of the molten alloy, e.g. magnesium or calcium.

These processes have, however, disadvantages. Thus the processes which require the addition to the melt of metallic compounds of the type of calcium carbide, calcium silicide, or calcium oxide, magnesium oxide or the manganese oxide MnO, do not yield high efficiency of desulfurization (i.e. the reduction in the concentration of sulfur in the alloy to a very low value).

Furthermore, the yield of such processes is low (i.e. it is necessary to use a relatively large quantity of the metallic compound to treat a given quantity of the alloy). Moreover, the process is accompanied by the formation of a large volume of slag or dross.

The processes which utilize the elemental metal such as magnesium and calcium for the desulfurization of a ferrous alloy are dangerous because of the risk of explosion inherent in the high reactivity and volatility of these metals.

It has been proposed to eliminate or attenuate these disadvantages, to utilize these metals not in a pure state, but in the form of alloys-- for example in the form of the alloy Al—Ca—Si—Mn—Fe. The use of such an alloy increases the cost of the process, reduces the yield and limits the efficiency.

In order to improve the properties of cast iron by transforming it into nodular iron, a problem which has been termed "nodularization", it has been suggested to treat the molten cast-iron melt (gray cast iron) by introducing into it a certain quantity of an appropriate metal such as magnesium.

This process has the disadvantage that it leads to the formation of sulfur and eventually magnesium oxide, whose presence unfavorably alters the physical properties of the iron.

To eliminate this disadvantage, it has been proposed (U.S. Pat. No. 2,882,266) to form magnesium in situ in the molten iron by the reduction of magnesium chloride ($MgCl_2$) with calcium silicide after having first reduced the levels of sulfur and oxygen in the melt. Similarly it has been suggested to form sodium in situ by the reduction of sodium chloride with calcium silicide.

To that effect, the latter patent provides for the successive introduction into the melt of a mixture of at least 30% and at most 50% by weight sodium chloride with at least 50% and at most 70% by weight calcium silicide, and then a mixture of at least 30% and at most 50% by weight magnesium chloride with at least 50% and at most 70% by weight calcium silicide.

However, because of the evaporation, the yield based upon the quantity of salt used is small and the process is further characterized by the evolution of noxious fumes upon the voltalization of sodium chloride and magnesium chloride.

The loss of sodium chloride and magnesium chloride in this manner is a consequence of the fact that NaCl and $MgCl_2$ do not form a homogenous liquid phase with calcium silicide at the temperature of the melt.

OBJECT OF THE INVENTION

It is the principal object of the present invention to eliminate the aforedescribed disadvantages.

Another object of the invention is to provide an improved method of treating a ferrous melt with high yield, low evolution of noxious fumes, and high efficiency.

Yet another object of this invention is to provide an improved composition for use as an additive to a ferrous melt in the treatment thereof.

DESCRIPTION OF THE INVENTION

The process of the present invention comprises treatment of a ferrous alloy for the desulfurization or nodularization thereof with a mixture consisting essentially of:

a. at least one reducing compound of an element of Group I, Group II, or Group III of the Periodic Table, except for hydrogen and boron, and at least one element selected from the group which consists of hydrogen, boron, carbon, silicon, nitrogen, phosphorous and combinations of at least one of the latter elements with sulfur; and b. at least one compound reducible by said reducing compound and containing a metal selected from the group which consists of the alkline metals (Group I) and the elements of Group II and Group III of the Periodic Table.

The compositions of this mixture which are suitable for the purposes of the present invention are, further, those within the portion of the phase diagram of the mixture corresponding to a single homogeneous liquid phase at temperatures above the melting point of the alloy to be treated. The mixture is brought into contact with the alloy, preferably after the latter has been brought to a temperature at least equal to its melting point, in the form of a homogeneous liquid or of a substantially homogeneous solid permitting homogeneous melting in contact with the alloy.

The Periodic Table or periodic arrangement of the elements referred to above may be that which is found on page 444 and 445 of the *HANDBOOK OF CHEMISTRY AND PHYSICS,* 41st edition, 1959–1960, CHEMICAL RUBBER PUBLISHING COMPANY, CLEVELAND, OHIO.

The reducing compound (a) is preferably selected from the group which consists of the carbides of the alkaline earth metals such as calcium carbide $CaC_2$ and barium carbide $BaC_2$.

Preferably the reducing compound is pure calcium carbide or a mixture of calcium carbide with at least one of the other reducing compounds.

The compositions of the mixture is preferably one of the following five types (percent by weight):

Mixtures of type No 1

$CaCl_2$ = 30 to 70
NaCl = 30 to 70
$CaC_2$ = 5 to 30
CaO = 1 to 15

Mixtures of type No. 2

$CaF_2$ = 20 to 50
NaCl = 30 to 70
$CaCl_2$ = 0 to 50
$CaC_2$ = 5 to 30
CaO = 1 to 15

Mixtures of type No. 3

NaF = 20 to 60
$CaF_2$ = 20 to 60
$CaC_2$ = 5 to 30
CaO = 1 to 15

Mixtures of type No. 4

$CaCl_2$ = 40 to 70
$MgF_2$ = 20 to 50
$CaC_2$ = 5 to 30
CaO = 1 to 15

Mixtures of type No. 5

$CaCl_2$ = 20 to 50
NaCl = 10 to 40
$MgF_2$ = 10 to 40
$CaC_2$ = 5 to 30
CaO = 1 to 15

As the reducible compound (b), we prefer to employ a halide, and oxide or a sulfide of an alkaline metal, an alkaline-earth metal, beryllium, magnesium or another metal from Groups 1a, 11a and 111b of the Periodic Classification. A mixture of at least two of such compounds may also be used. Preferably we employ a halide or an oxide or a mixture of at least two halides or oxides of metal from one of the classes last indicated in the case where it is desired to avoid introducing sulfur per se or in a combined state into the alloy to be treated.

It is particularly advantageous to use as the reducible compound, a mixture of at least two reducible compounds, for example a binary mixture such as sodium chloride-magnesium fluoride (NaCl—$MgF_2$), or the mixture sodium chloride-sodium fluoride (NaCl—NaF), these compounds having different reducing temperatures, to obtain a progressive liberation of the reduced metal, such as sodium and magnesium, during the treatment of the metal alloy.

Thus the invention utilizes the reducing effect of compounds of elements of Groups I, II and III and hydrogen or of metalloids or combinations metalloids having a less pronounced oxidizing character (boron, carbon, silicon, nitrogen, phosphorous, thiocyanate SCN, etc.) upon the halides, oxides and sulfides of the alkaline metals or alkaline-earth metals and upon the halides, oxides and sulfides of beryllium or magnesium or the other metals of Groups II or III of the Periodic Classification of the elements, in particular the lanthanides and the actinides, to form the metals corresponding thereto in situ in the alloy and bring about the reaction between these metals with the sulfur or oxygen and/or, in the particular case of gray iron, the nodularization effect which has already been recognized in the art.

The advantages which result from the system of the present invention derive from the fact that the mixture which has been described above is in a homogeneous form during the formation of the active metal so that substantially all of the ingredients of the mixture are effectively utilized and all volatilization of halides is avoided. The sulfides and oxides which are formed are rapidly entrained toward the free surface of the molten alloy where they dissolve totally or partially in the slag. The viscosity and the surface tension of the slag are particularly favorable to an effective decantation thereof and a good cleaning of the metal.

The reaction mechanism of the system of the present invention is probably the following:

On contact of the molten alloy with the mixture, the latter is transformed into a liquid state at least at the regions in contact with the alloy and the result is a liquid-liquid interaction.

When the mixture reaches a temperature sufficient to initiate the reduction of the reducible compound, the metal corresponding thereto is generated in a nascent state of particularly high reactivity within the molten alloy.

The nascent active metal reacts with the alloy, for example with formation of the sulfide corresponding to the sulphur which is dissolved in the alloy or in the case of gray cast iron to bring about nodularization of the iron.

Finally the new compounds formed by the reaction of the nascent metal with the alloy, for example the sulfide of the active metal, separate themselves in the liquid state from the alloy and rise to the surface to the molten alloy from which it is possible to separate the reaction product by decantation.

Apart from the reducing and reducible compounds, the mixture according to the invention can comprise at least one other compound playing the role of a flux or slag-forming agent and permitting reduction of the melting point of the mixture and/or adjusting its viscosity and/or its density in the molten state to a suitable value. For example, it is possible to use at least one compound selected from the group of halides and oxides of alkaline metals or alkaline-earth metals or magnesium or beryllium, especially the halides, oxides and sulfides of sodium, calcium, fluoride ($CaF_2$) or calcium chloride ($CaCl_2$).

When the process of the present invention is carried out by introducing the mixture into the molten alloy in the form of a single homogeneous liquid phase, the preparation of the mixture is effected by a simple melting of the ingredients, preferably by the melting of a mixture of the solid compounds in the desired proportions.

Preferably, however, the molten mixture can be produced by first melting one or more of the halides and thereafter introducing into the melt of the halides the auxiliary and other compounds. The latter-introduced compounds may be other halides, oxides, sulfides. Then there is introduced into the liquid bath the reducing compound of a metal of groups I, II or III and metalloids in one or more fractions, preferably in granular or pulverent form in a quantity corresponding to the proportion of the reducing compound to be present in the mixture and within the limits of solubility of the compound in the liquid bath.

It is to be understood, of course, that this technique is not applicable where the melting point of the mixture is less than the temperature at which the reduction reaction commences, i.e. less than the reduction temperature of the halide under atmospheric pressure.

In the case in which the melting point of the mixture is greater than the temperature at which the reduction-reaction of the halide commences, one uses the technique described above in which the alloy melt is contacted with a solid mixture of the composition according to the invention. In this case, one obtains the requisite homogeneity of the solid phase, for example, by mixing the ingredients of the mixture as homogeneously as possible in pulverent form, thereafter sintering the powder or forming a frit or clinker therefrom in order to obtain a number of bodies which are coherent such as sintered pellets. The cohesion of the sintered pellets may be due, for example, to the melting of regions of the particles together at eutectics formed between two or more of the constitutents of the mixture.

According to another embodiment of the invention, applicable in the case where the melting point of the mixtures is less than the reaction temperature of reduction of the halide, comprises forming initially a homogeneous liquid phase having the overall composition of the mixture and then proceeding in the manner described above except that instead of introducing the mixture into the molten alloy in a liquid state, permitting the melt to cool to a temperature below its solidification point and finally subdividing the resulting homogeneous solid mass, preferably into a powder or into granules which are introduced into the alloy.

The introduction of the mixture, whether in a liquid state or in a solid state, into the alloy melt can be effected without difficulty by conventional devices such as graphite domes, or injection lances using, where necessary, an entraining stream of gas, for example dry air or an inert gas such as argon or nitrogen. The use of a graphite dome is particularly desirable because this device does not need a carrier gas which diminishes the vapor pressure of the nascent metal formed on reduction and thus might reduce the residence time of this metal in the alloy.

Specific Examples

EXAMPLE I

A melt (dehydrated or anhydrous) of sodium fluoride and calcium fluoride having a weight composition of:

$NaF = 56.3\%$ and
$CaF_2 = 43.7\%$ is heated to 90° C under a nitrogen atmosphere at atmospheric pressure. A quantity of calcium carbide (technical grade containing 78% by weight of $CaC_2$, the balance being lime, CaO) corresponding to 25% by weight of the mixture is dissolved in this melt. The resulting mixture is a homogeneous liquid consisting of: (expressed in percents by weight).

$NaF = 45$
$CaF_2 = 35$
$CaC_2 = 15.6$
$CaO = 4.4$

The monogeneous liquid is permitted to solidify by cooling. The solid is broken up into small pieces and is used as a slag for the desulfurization of a hematite melt, the desulfurization treatment being carried out as follows:

A graphite dome is immersed in the hematite melt at a temperature of 1300° C and 1% by weight of the "slag" (based on the weight of the melt), as enclosed in the dome, is introduced over a period of 15 minutes during which the dome is immersed in the melt.

Similarly a graphite dome containing the same quantity of slag is introduced under the same conditions and over the same period.

The hematite melt, originally contains 0.04% by weight sulfur and, after the first treatment, the sulfur content is reduced to 0.02% by weight and after the second treatment to 0.006% by weight.

EXAMPLE II

An anhydrous or dehydrated melt of calcium carbide and sodium chloride having the following compositions by weight:

$CaCl_2 = 60\%$
$NaCl = 40\%$, is heated to 870° C under a nitrogen atmosphere at atmospheric pressure. Technical grade calcium carbide is then dissolved under nitrogen in the melt to yield a homogeneous liquid composition consisting of (in present by weight):

$CaCl_2 = 51$
$NaCl = 34$
$CaC_2 = 11.7$
$CaO = 3.3$

The homogeneous liquid mass is solidified by cooling and the homogeneous solid is then ground to a powder of a particle size below 0.5 millimeters.

The powder is injected into a ladle containing a hematite melt at a temperature of 1300° C using a stream of nitrogen as the carrier gas.

Where the hematite originally contained 0.04% by weight sulfide, one injection operation with a quantity of the powder equal to 1% by weight of the melt, reduces the sulfur content to 0.22%. The duration of injection was 10 minutes. The sulfur content was reduced to 0.01% by weight after a second operation identical to the first so that the total powder quantity was 2% by weight of the melt.

EXAMPLE III

The process is the same as in EXAMPLE I but using as the starting mixture a mixture of calcium chloride and magnesium fluoride having a weight composition:

$CaCl_2 = 80\%$
$MgF_2 = 20\%$

To the initial mixture at 900° C the technical grade calcium carbide is then added to form a homogeneous composition as follows: (percents by weight)

$CaCl_2 = 64$
$MgF_2 = 16$ $CaC_2$ = 15.6
CaO = 4.4.

The homogeneous solid fragmented product is used as "slag" for the desulfurization of a hematite melt including initially 0.04% by weight sulfur.

This is done in a manner similar to that of EXAMPLE I but maintaining the melt at 1350° C during the desulfurizing treatment and utilizing a quantity of the "slag" equal to 0.5% by weight of the melt for each operation.

The duration of each operation is ten minutes instead of 15 minutes.

After one operation the sulfur content is reduced to 0.025% by weight of the melt.

After two operations the sulfur content is reduced to 0.012% and after three operations to 0.006% by weight of the melt.

EXAMPLE IV

The procedure of EXAMPLE II is followed with the modifications given below:

Weight composition of the initial saline mixture:

NaCl = 44.6%
$CaCl_2$ = 27.7%
$MgF_2$ = 27.7%.

Weight percent composition of final mixture:

NaCl = 36
$CaCl_2$ = 22
$MgF_2$ = 22
$CaC_2$ = 15.6
CaO = 4.4.

Weight of power injected into the melt per operation in percent of the melt by weight: 0.75%

Duration of injection: 5 minutes

Results for hematite melt originally containing 0.04% by weight sulfur:

a. after one operation
S = 0.021% by weight
b. after two operations
S = 0.008% by weight.

EXAMPLE V

In a manner analagous to that of EXAMPLE I, a silicon steel having the following composition (percent by weight):

C = 0.020%
Si = 3.12%
S = 0.027%
P = 0.01%
balance iron, was treated. Such steel has the disadvantage that it is fragmented when hot by the sulfur, i.e., is subject to "hot cracking".

The desulfurizing "slag" is a solid mixture of the following composition (in percent by weight):

$CaF_2$ = 63
$CaCl_2$ = 15
CaO = 4.3
$MgF_2$ = 8.2
$CaC_2$ = 3.1
$CaSi_2$ = 6.4.

This mixture is prepared by combining the ingredients in the form of a powder to produce homogeneous pulverent mix. The latter is agglomerated into pellets of a diameter of three centimeters and a thickness of one centimeter. The pellets are sintered at 1000° C.

The pellets are used as follows:

proportion of slag employed in percent by weight of the treated steel: 0.45%
temperature of steel during treatment: 1600° C
duration of immersion of graphite dome enclosing the slag in the melt: 20 minutes.

Upon contact with the molten steel, the pellets melt rapidly and form a homogeneous liquid which liberates gaseous magnesium. The latter reacts in situ with the sulfur and the molten steel. The magnesium thus formed dissolves in part of the slag which rises to the surface of the steel bath at the end of the operation.

The final composition of the treated steel (in percent by weight) is as follows:

C = 0.025
Si = 3.14
S = 0.012
P = 0.009 balance iron.

The steel is substantially less susceptible to hot cracking than the starting steel.

EXAMPLE VI

The procedure is the same as that in EXAMPLE II except in the following respects:

treated melt = molten steel having the composition, in percent by weight, of C = 0.35; cMn = 0.60; Si = 0.25; P = 0.033; S = 0.05; balance iron.

Desulfurizing agents = the desulfurizing slat is a powder formed by comminuting a homogeneous solid solution of the following empirical composition in percent by weight:

$CaF_2$ = 38
NaF = 39
$CaC_2$ = 18
CaO = 5

Preparation of desulfurizing slag: the solid solution is prepared in the manner described in EXAMPLE II by dissolving technical grade calcium carbide (78% by weight calcium carbide, 22% by weight calcium oxide) in an anhydrous or dehydrated molten mixture of calcium fluoride and sodium fluoride at 950° C.

After complete dissolution of the technical calcium carbide, assisted by effective agitation of the liquid mixture, the mixture is solidified by cooling. The mixture is then ground to a powder of a particle size between 0.1 and 0.5 millimeters.

Treatment technique: the steel melt is treated by injecting the powder pneumatically therein.

Proportion of slag used: 0.3% by weight of the steel melt.

Temperature of steel during treatment: 1600° C.

Duration of injection: 10 minutes.

The composition of the steel bath reached equilibrium about 10 to 20 minutes after the termination of injection.

Final composition of steel (percent by weight):

C = 0.0365
Mn = 0.60
Si = 0.24

P = 0.033
S = 0.020 balance iron.

EXAMPLE VII

The technique of EXAMPLE VI is used except for the following modifications:

steel melt to be treated (percent by weight):

C = 0.07
O = 0.035
S = 0.025 balance iron.

Treatment slag = a powdered homogeneous solid solution of the following composition (percent by weight):

$CaF_2$ = 12
$CaCl_2$ = 48
$MgF_2$ = 20
$CaC_2$ = 16
CaO = 4.

Conditions of preparation of solid solution:

initial mixture = anhydrous or dehydrated $CaF_2$, $CaCl_2$, $MgF_2$ in which technical calcium carbide is dissolved at 800° C.

Quantity of slag used = 1.42% by weight of the treated steel.

Temperature of steel during treatment = 1600° C.

Duration of injection = 20 minutes.

Equilibrium of the composition of the steel bath is obtained after about 15 to 20 minutes following injection of the "slag". During this period decantation is observed.

Magnesium oxide and magnesium sulfide, as formed, are entrained to the surface of the liquid steel and are dissolved in the slag layer overlying the steel melt. Because of the low viscosity of the mixture, the slag is decanted almost completely so that the solidified steel ingot, cast from the melt is found to contain only insufficient quantities of nonmetallic inclusions.

The final steel composition (percent by weight):

C = 0.15
S = 0.01
Oxygen less than 0.0005
Mg = 0.005
balance iron.

The treatment desulfurizes, deoxidizes and adjusts the carbon content of a steel melt simultaneously.

EXAMPLE VIII

The process is analogous to that described in EXAMPLE I except as follows: iron melt composition (percent by weight) =

C = 3.9
Si = 1.2
Mn = 0.12
S = 0.007
P = 0.04 balance iron.

Treatment slag: pieces of homogeneous solid solution of the composition (percent by weight):

$CaCl_2$ = 60
$MgF_2$ = 20
$CaC_2$ = 15.6
CaO = 4.4

Initial mixture: anhydrous or dehydrated 70% by weight $CaCl_2$ plus 25% by weight $MgF_2$ in which the technical grade calcium carbide is dissolved at 920° C.

Quantity of treatment slag used = 0.75% by weight of the treated iron melt.

Temperature of the iron melt during treatment = 1430° C.

Duration of immersion of graphite dome enclosing treatment slag = 15 minutes.

After treatment the iron is found to be of the spherical graphite type cast iron.

EXAMPLE IX

An anhydrous or dehydrated mixture of calcium fluoride ($CaF_2$) and calcium chloride ($CaCl_2$) in amounts corresponding to their eutectic (16.4 mole percent $CaF_2$) is melted and then technical grade calcium carbide is dissolved in the liquid bath thus obtained. The amount of technical grade calcium carbide added corresponds to 19% by weight of the total weight of the solution, the temperature during dissolution of the technical grade calcium carbide being maintained between 1100° and 1200° C at atmospheric pressure and in contact with the atmosphere. After complete dissolution of the calcium, the temperature of the bath is reduced to 900° C and sodium chloride is introduced into it. The sodium chloride, in an amount of 1.46 kilograms per kilogram of calcium carbide, dissolves entirely. The resulting homogeneous liquid slag has the composition (percent by weight):

$CaF_2$ = 11
$CaCl_2$ = 56
$CaC_2$ = 12.7
CaO = 2.3
NaCl = 17

Other mineral substances not readily identifiable and included as impurities in the calcium carbide = 1.

This mixture is cooled to solidify it and the solvent is then ground to produce a granular product with an average granulometry of the order of 1 millimeter.

The solid grains are injected pneumatically molten iron melt in a pouring ladle in an amount of 6 kilograms of the mixture pure ton of the iron. 150 kilograms of the mixture per minute is the rate of injection.

We claim:

1. A process for treating a molten metal which includes contacting said molten metal with a mixture comprising at least one first compound selected from the group consisting of the halides and oxides of the metallic elements of groups Ia, IIa and IIIb of the periodic classification of the elements and at least one second compound capable of reducing said first compound to the corresponding metallic element in said molten metal, wherein said mixture is in the form of a single liquid homogeneous phase at the temperature of said molten metal.

2. The process defined in claim 1 wherein said mixture is contacted with said molten metal in the form of homogeneous liquid phase.

3. The process defined in claim 1 wherein said mixture is contacted with said melt in the form of a solid phase having a melting point below the temperature of the molten metal upon such contact whereby the solid mixture fuses to a homogeneous liquid upon contact with the molten melt.

4. The process defined in claim 1 wherein said reducing compound is calcium carbide

5. The process defined in claim 1 in which said reducible compound is a halide of an alkali metal, or an alkaline-earth metal.

6. The process defined in claim 1 wherein said mixture includes at least one other compound for lowering the melting point of the mixture.

7. The process defined in claim 1 wherein said miture includes at least one other compound for reducing the viscosity of the mixture.

8. The process defined in claim 1 wherein said mixture includes at least one other compound for modifying the density of said mixture in a liquid state.

9. The process defined in claim 1 wherein said mixture includes a further compound for modifying a property of the mixture and having the same cation as the reducing compound.

10. The process defined in claim 1 wherein said mixture contains calcium carbide, at least one alkali-metal halogenide and at least one calcium halogenide.

11. The process defined in claim 10 wherein said mixture consists of in percent by weight:

$CaCl_2$ = 30 to 70
NaCl = 30 to 70
$CaC_2$ = 5 to 30
CaO = 1 to 15

12. The process defined in claim 10 wherein said mixture consists of in percent by weight:

$CaF_2$ = 20 to 50
NaCl = 30 to 70
$CaCl_2$ = 0 to 50
$CaC_2$ = 5 to 30
CaO = 1 to 15

13. The process defined in claim 10 wherein said mixture consists of in percent by weight:

NaF = 20 to 60
$CaF_2$ = 20 to 60
$CaC_2$ = 5 to 30
CaO = 1 to 15

14. The process defined in claim 10 wherein said mixture consists of in percent by weight:

$CaCl_2$ = 40 to 70
$MgF_2$ = 20 to 50
$CaC_2$ = 5 to 30
CaO = 1 to 15

15. The process defined in claim 10 wherein said mixture consists of in percent by weight:

$CaCl_2$ = 20 to 50
NaCl = 10 to 40
$MgF_2$ = 10 to 40
$CaC_2$ = 5 to 30 CaO = 1 to 15

16. The process defined in claim 10 wherein said mixture consists of in percent by weight:

$CaF_2$ = 38
NaF = 39
$CaC_2$ = 18
CaO = 5.

17. The process defined in claim 10 wherein said mixture consists of in percent by weight:

$MgF_2$ = 20
$CaF_2$ = 12
$CaC_2$ = 16
CaO = 4
$CaCl_2$ = 48

18. The process defined in claim 10 wherein said mixture consists of in percent by weight:

$CaCl_2$ = 60
$MgF_2$ = 20
$CaC_2$ = 15.6
CaO = 4.4

19. A process for the treatment of a ferrous metal melt which comprises contacting said melt with a homogeneous mixture of:

a. at least one reducing agent consisting of a compound of an element from one of the groups I, II and III of the Periodic Classification of the elements aside from hydrogen and boron, and at least one element selected from the group which consists of hydrogen, boron, carbon, silicon, nitrogen, and phosphorus or a combination thereof with sulfur; and b. at least two different compounds reducible by said reducing agent, each of said reducible compound containing at least one metal selected from the group which consists of the alkali metals and the metals of Group II and III of the Periodic Classification of the elements, said reducible compounds having different reaction temperatures at which the metals thereof are to obtain progressive liberation of the metals in elemental form at different times of contact with the melt, the composition of said mixture lying within that portion of the phase diagram of its constituents which corresponds to the existence of a single liquid homogeneous phase at temperatures above the melting point of the melt.

20. The process defined in claim 19 wherein the two reducible compounds contain the same metals to be progressively liberated in elemental form.

21. The process defined in claim 20 wherein the two reducible compounds are sodium chloride and sodium fluoride.

22. The process defined in claim 19 wherein the two reducible compounds contain different metals in higher oxidation states to be progressively liberated in elemental form.

23. The process defined in claim 22 wherein the two compounds are sodium chloride and magnesium fluoride.

* * * * *